US008444372B2

(12) United States Patent
Suthar et al.

(10) Patent No.: US 8,444,372 B2
(45) Date of Patent: May 21, 2013

(54) PASSIVE COOLING SYSTEM FOR A TURBOMACHINE

(75) Inventors: Rajnikumar Nandalal Suthar, Gujarat (IN); Sanjeev Kumar Jain, Karnataka (IN); Joshy John, Karnataka (IN)

(73) Assignee: General Electric Company, Schenectady, NY (US)

( * ) Notice: Subject to any disclaimer, the term of this patent is extended or adjusted under 35 U.S.C. 154(b) by 32 days.

(21) Appl. No.: 13/022,039

(22) Filed: Feb. 7, 2011

(65) Prior Publication Data

US 2012/0201650 A1 Aug. 9, 2012

(51) Int. Cl.
*F04D 21/00* (2006.01)

(52) U.S. Cl.
USPC ..... 415/1; 415/116; 415/175

(58) Field of Classification Search
USPC ..... 415/108, 114, 116, 175, 177, 914, 415/1
See application file for complete search history.

(56) References Cited

U.S. PATENT DOCUMENTS

| | | | | |
|---|---|---|---|---|
| 4,497,610 | A * | 2/1985 | Richardson et al. | 415/116 |
| 5,267,831 | A * | 12/1993 | Damiral | 415/114 |
| 5,584,651 | A * | 12/1996 | Pietraszkiewicz et al. | 415/115 |
| 5,993,150 | A * | 11/1999 | Liotta et al. | 415/115 |
| 6,139,257 | A | 10/2000 | Proctor et al. | |
| 6,471,480 | B1 | 10/2002 | Balkcum, III et al. | |
| 6,499,950 | B2 | 12/2002 | Willett et al. | |
| 6,506,022 | B2 | 1/2003 | Banker | |
| 7,104,751 | B2 * | 9/2006 | Naik et al. | 415/116 |
| 7,246,993 | B2 * | 7/2007 | Bolms et al. | 415/116 |
| 7,665,962 | B1 * | 2/2010 | Liang | 415/173.1 |
| 2001/0006600 | A1 | 7/2001 | El-Nashar et al. | |
| 2008/0118346 | A1 * | 5/2008 | Liang | 415/115 |
| 2009/0304520 | A1 | 12/2009 | Brittingham et al. | |

FOREIGN PATENT DOCUMENTS

| | | | |
|---|---|---|---|
| EP | 1176285 | A2 | 1/2002 |
| EP | 1213444 | A2 | 6/2002 |
| EP | 2009248 | A1 | 12/2008 |
| WO | 03054360 | A1 | 7/2003 |

OTHER PUBLICATIONS

Search Report and Written Opinion from EP Application No. 12154127.0 dated Jun. 20, 2012.

* cited by examiner

*Primary Examiner* — Edward Look
*Assistant Examiner* — Jason Davis
(74) *Attorney, Agent, or Firm* — Cantor Colburn LLP

(57) ABSTRACT

A turbomachine includes a housing having an outer surface and an inner surface that defines an interior portion. The housing includes a fluid plenum. A rotating member is arranged within the housing. The rotating member includes at least one bucket having a base portion and a tip portion. A stationary member is mounted to the inner surface of the housing adjacent the tip portion of the at least one bucket. At least one fluid passage passes through at least a portion of the stationary member. The at least one fluid passage includes a fluid inlet fluidly coupled to the fluid plenum and a fluid outlet exposed to the interior portion. The fluid outlet being configured and disposed to direct a flow of fluid toward the tip portion of the at least one bucket.

18 Claims, 6 Drawing Sheets

PASSIVE COOLING SYSTEM FOR A TURBOMACHINE

BACKGROUND OF THE INVENTION

The subject matter disclosed herein relates to the art of turbomachines and, more particularly, to a passive cooling system for a turbomachine.

Turbomachines typically include a compressor operationally linked to a turbine. Turbomachines also include a combustor that receives fuel and air which is mixed and ignited to form a high energy fluid or hot gases. The hot gases are then directed into a hot gas path toward turbine buckets or blades. Energy from the hot gases imparts a rotational force to the turbine blades. During operation, a portion of the hot gases escapes from the hot gas path and flows over a cover portion of the blades. The hot gases typically impinge upon a front, top side of the cover portion. Continuous exposure to the hot gases leads to a significant reduction in blade tip creep life. As such, cooling tip portions of the blades will lead to a longer service life for the turbomachine. Currently there exist various cooling systems for lowering turbine blade temperatures. Conventional cooling systems pass a cooling flow internally though rotating airfoil portions of the blades. The cooling airflow either travels through the rotating airfoil portions and passes out from tip portions of the blades, or circulates back through the airfoil portions.

BRIEF DESCRIPTION OF THE INVENTION

According to one aspect of the invention, a turbomachine includes a housing having an outer surface and an inner surface that defines an interior portion. The housing includes a fluid plenum. A rotating member is arranged within the housing. The rotating member includes at least one bucket having a base portion and a tip portion. A stationary member is mounted to the inner surface of the housing adjacent the tip portion of the at least one bucket. At least one fluid passage passes through at least a portion of the stationary member. The at least one fluid passage includes a fluid inlet fluidly coupled to the fluid plenum and a fluid outlet exposed to the interior portion. The fluid outlet is configured and disposed to direct a flow of fluid toward the tip portion of the at least one bucket.

According to another aspect of the invention, a method of passively cooling a turbomachine includes rotating a rotating member that includes at least one bucket having a tip portion. The tip portion passes in proximity to a stationary member. A fluid flow is passed through a fluid plenum, formed in a housing of the turbomachine, toward the stationary member. The fluid flow is guided through at least one fluid passage, that extends from the fluid plenum through at least a portion of the stationary member, toward the tip portion of the at least one bucket for passively cooling the turbomachine.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
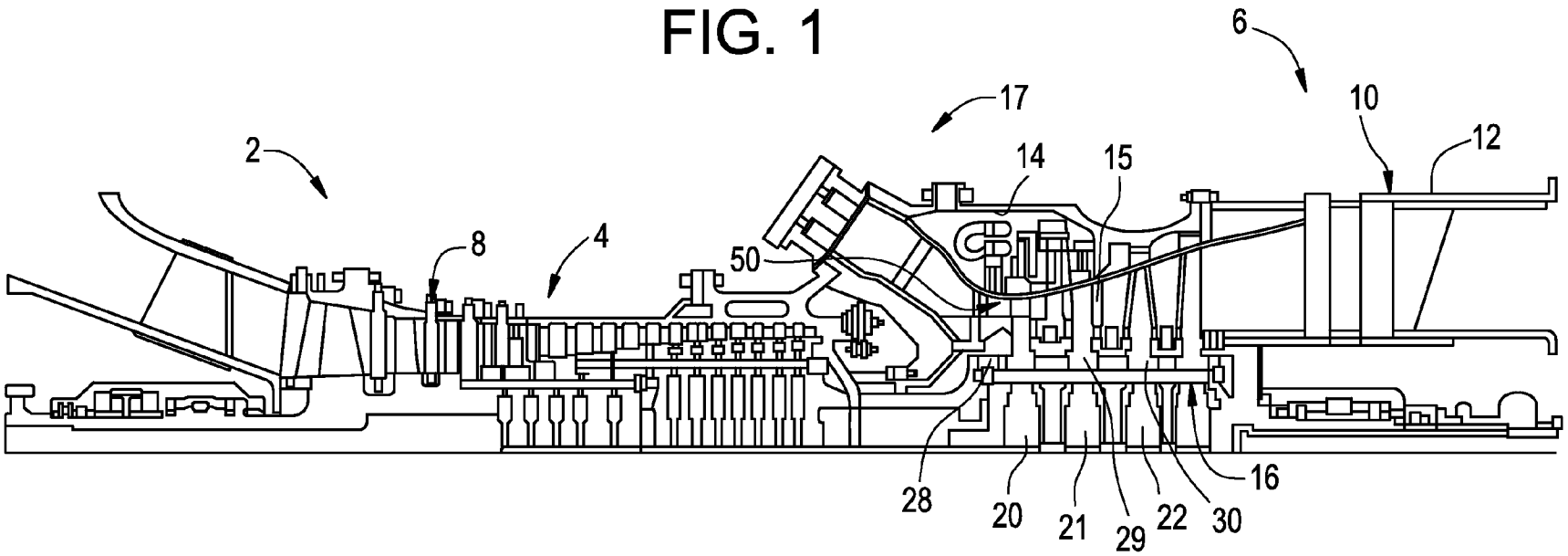
FIG. 1 is a cross-sectional view of a turbomachine including a passive cooling system in accordance with an exemplary embodiment.
Figure 2:
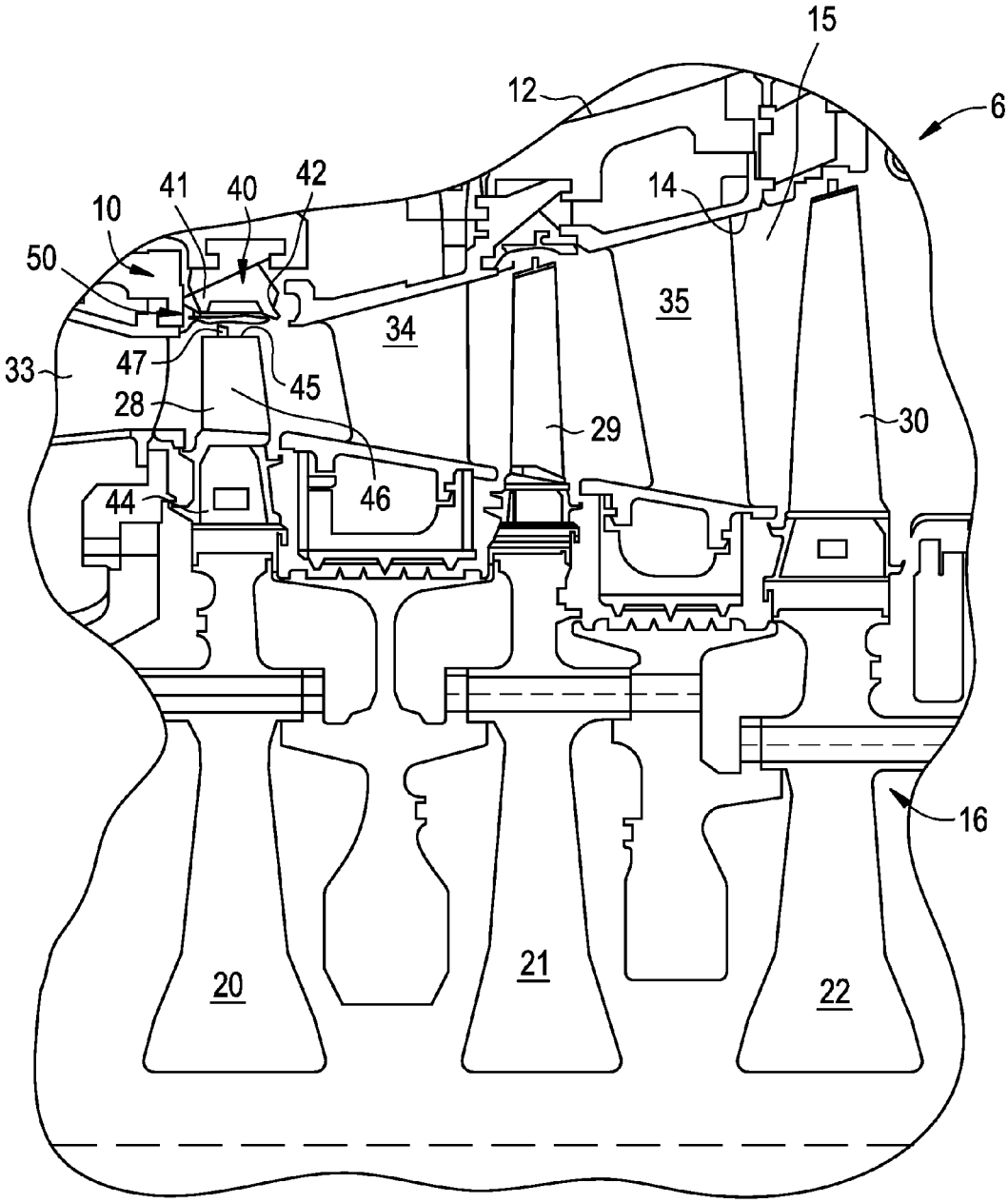
FIG. 2 is a detail view of a plurality of turbine stages of a turbine portion of the turbomachine of FIG. 1.

With reference to FIGS. 1 and 2, a turbomachine system constructed in accordance with an exemplary embodiment is indicated generally at 2. Turbomachine system 2 includes a first turbomachine that takes the form of a compressor portion 4 and a second turbomachine that takes the form of a turbine portion 6. Compressor portion 4 includes a compressor housing 8 and turbine portion 6 includes a turbine housing 10. Turbine housing 10 includes an outer surface 12 and an inner surface 14 that defines an interior portion 15. Compressor portion 4 is linked to turbine portion 6 through a common compressor/turbine shaft or rotor 16. Compressor portion 4 is also linked to turbine portion 6 through a plurality of circumferentially spaced combustors, one of which is indicated at 17. In the exemplary embodiment shown, turbine portion 6 includes first, second and third stage rotating members or wheels 20-22 having an associated plurality of blade members or buckets 28-30. Wheels 20-22 and buckets 28-30 in conjunction with corresponding stator vanes 33-35 define various stages of turbine portion 6. In operation, buckets 28-30 rotate in close proximity to inner surface 14 of turbine housing 10.

In the exemplary embodiment shown, a plurality of stationary or shroud members, one of which is indicated at 40, is mounted to inner surface 14 through first and second hook sections 41 and 42. As will be discussed more fully below, shroud member 40 defines a flow path (not separately labeled) for high pressure gases flowing over buckets 28-30. At this point, it should be understood that each bucket 28-30 is similarly formed such that a detailed description will follow with reference to bucket 28 with an understanding that the remaining buckets 29 and 30 include corresponding structure. As shown, bucket 28 includes a first or base portion 44 that extends to a second or tip portion 45 through an airfoil portion 46. Tip portion 45 is shown, in the exemplary embodiment, to include a projection 47. Hot gases flowing through the flow path from combustor 17 pass between tip portion 45 of bucket 28 along inner surface 14 and shroud member 40. As such, tip portion 45 is exposed to elevated temperatures associated with the hot gases. In order to lower localized temperatures at tip portion 45, turbine portion 6 includes a passive cooling system 50.

Figure 3:
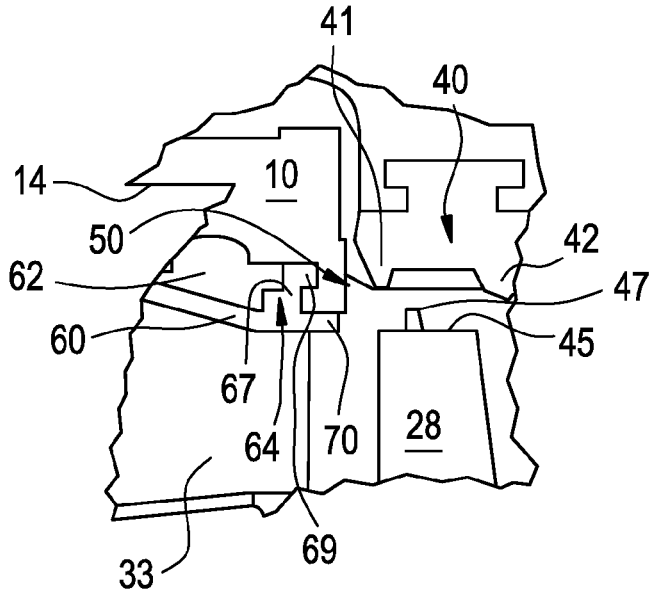
FIG. 3 is detail view of one of the plurality of turbine stages of FIG. 2 illustrating a shroud member connected to a housing member.
Figure 4:
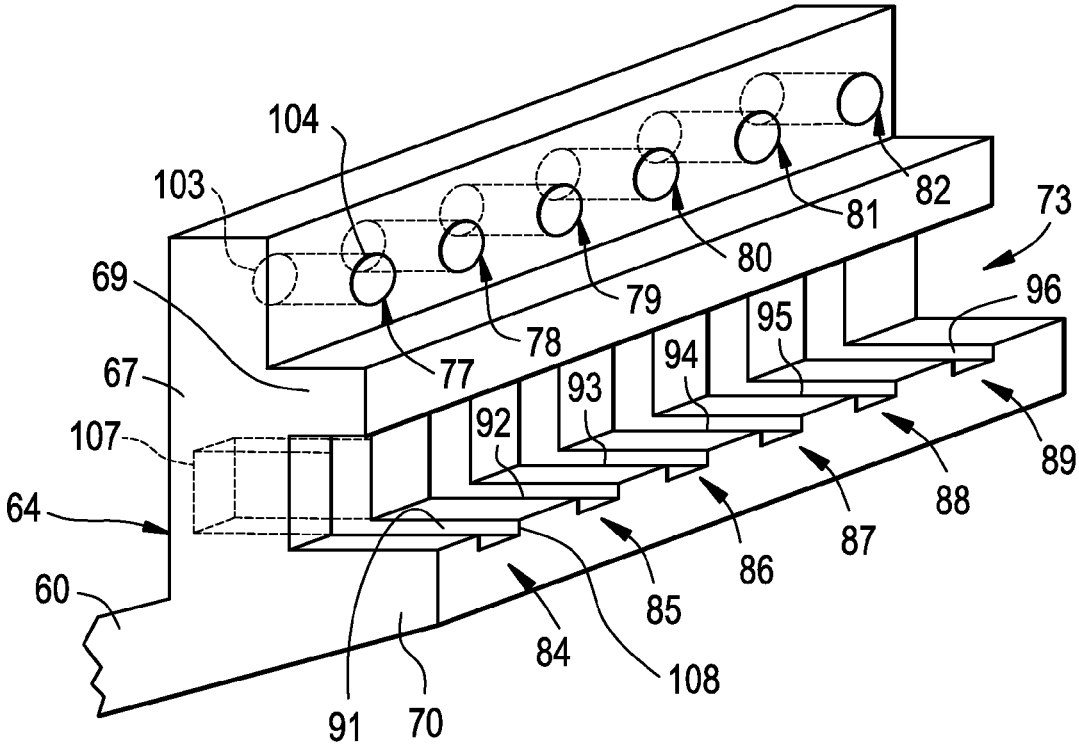
FIG. 4 is a lower partial perspective view of housing member of FIG. 3.
Figure 5:
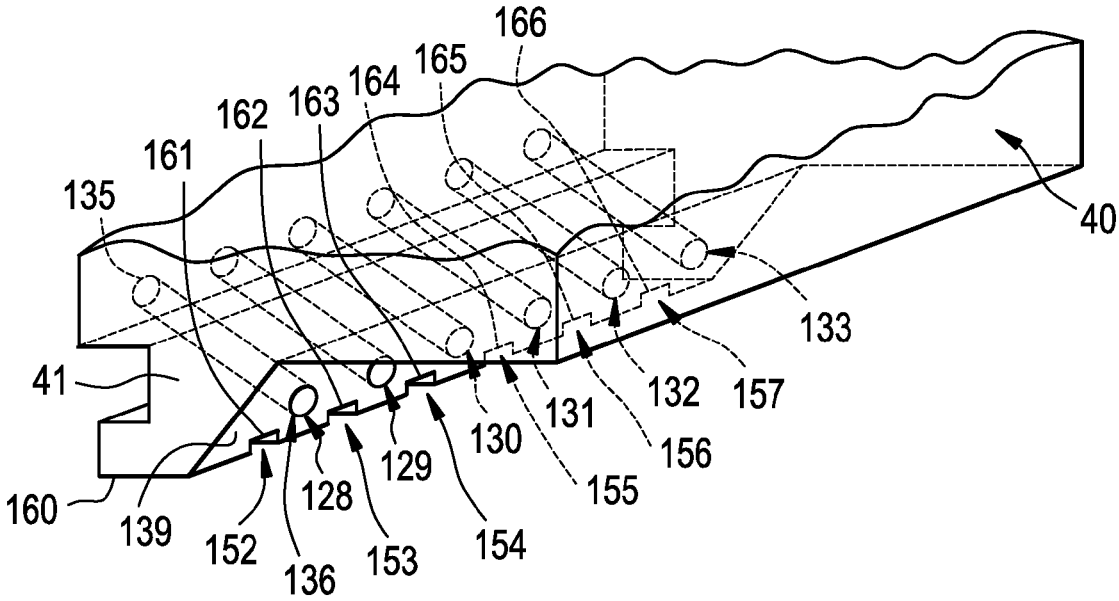
FIG. 5 is a lower partial perspective view of the shroud member of FIG. 3.

As best shown in FIGS. 3-5, turbine housing 10 includes a housing member 60 that defines, in part, a fluid plenum 62.

Housing member 60 includes a flange 64 having a first flange member 67, a second flange member 69, and a third flange member 70 that collectively define a channel 73. In accordance with an exemplary embodiment, flange 64 includes a first plurality of fluid passage sections 77-82 that extend through second flange member 69. Flange 64 also includes a plurality of channels 84-89 formed in third flange member 70. Channels 84-89 define a plurality of first fluid passage portions 91-96. As will become evident below, the first plurality of fluid passage sections 77-82 and channels 84-89 are fluidly connected to fluid plenum 62.

As each of the first plurality of fluid passage sections 77-82 are similarly formed, a detailed description will follow referencing fluid passage section 77 with an understanding that the remaining fluid passage sections 78-82 include corresponding structure. Fluid passage section 77 includes a first end or inlet 103 that extends to a second end or outlet 104. Inlet 103 is open to fluid plenum 62 and outlet 104 is open to interior portion 15. Similarly, as each of the plurality of first fluid passage portions 91-96 are similarly formed, a detailed description will follow referencing first fluid passage portion 91 with an understanding that the remaining fluid passage portions 92-96 include corresponding structure. Fluid passage portion 91 includes a first end or inlet section 107 that extends through flange 64 to a second end or outlet section 108. Inlet section 107 is open to fluid plenum 62 and outlet section 108 is open to interior portion 15.

Figure 6:
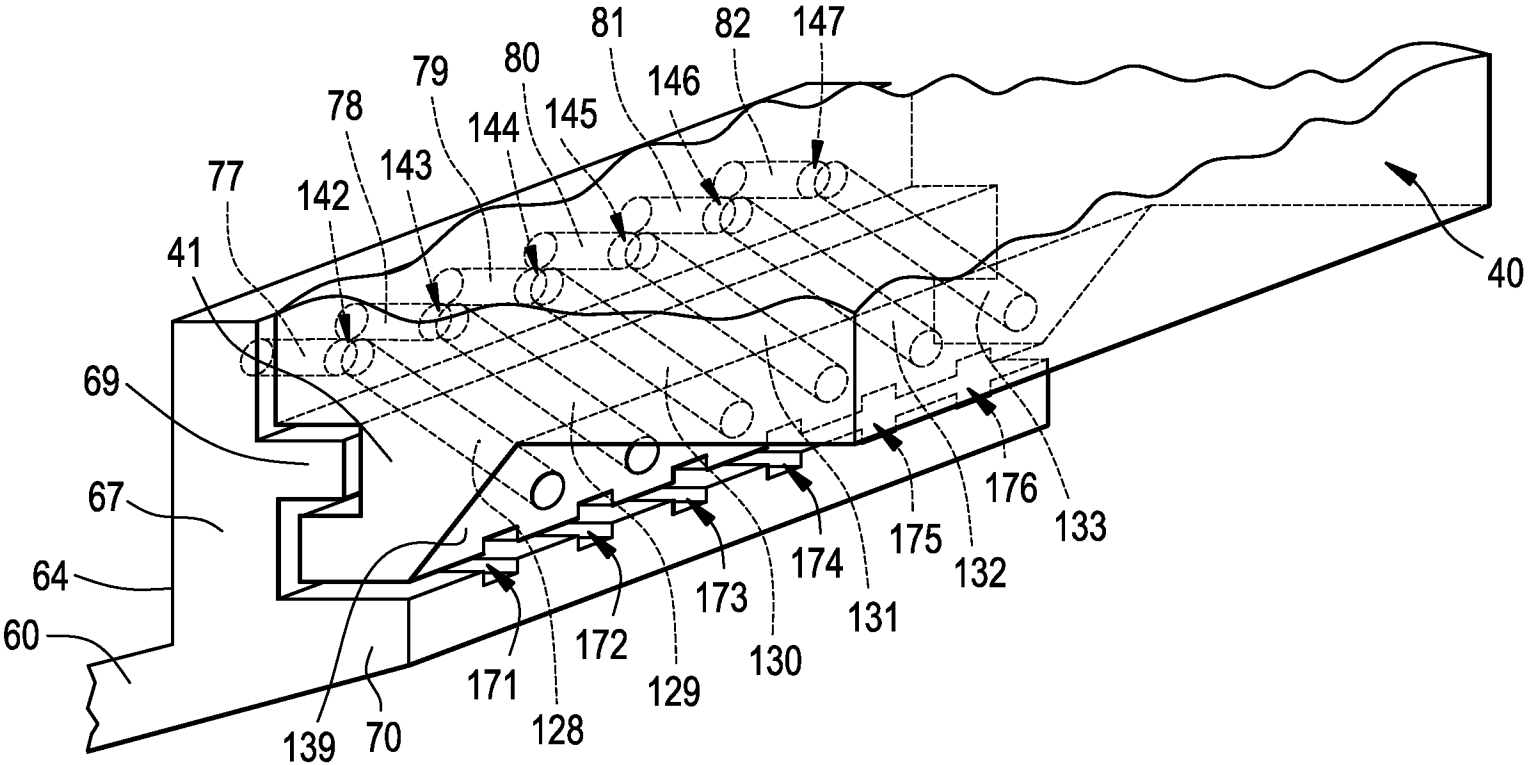
FIG. 6 is a lower partial perspective view of the shroud member connected to the housing member to form the passive cooling system of the exemplary embodiment.

In further accordance with the exemplary embodiment, shroud 40 includes a second plurality of fluid passage sections 128-133 that extend through hook section 41. Each of the second plurality of fluid passage sections 128-133 includes a fluid inlet 135 and a fluid outlet 136 such as shown on fluid passage section 128. Each fluid outlet 136 is formed on an angled surface 139 of shroud 40. As best shown in FIG. 6, each of the second plurality of fluid passage sections 128-133 registers with corresponding ones of the first plurality of fluid passage sections 77-81 to form a first plurality of fluid passages 142-147. Shroud 40 is also shown to include a plurality of channels 152-157 formed in an outer surface 160 of hook section 41. Channels 152-157 define a second plurality of fluid passage portions 161-166. Once shroud 40 is installed to turbine housing 10, the second plurality of fluid passage portions 161-166 register with the first plurality of fluid passage portions 91-96 to establish a second plurality of fluid passages 171-176.

Figure 7:
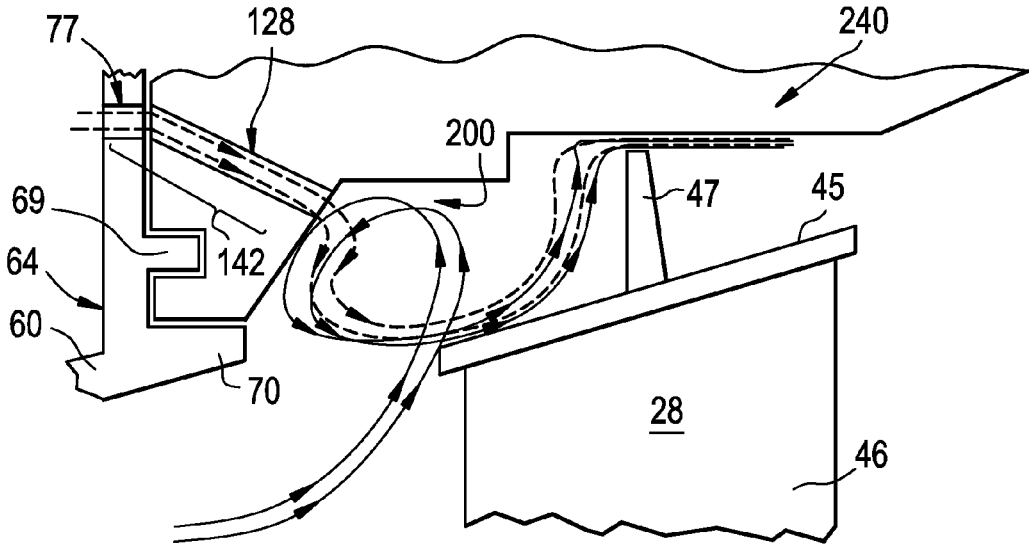
FIG. 7 is a schematic view of a turbine stage in accordance with another aspect of the exemplary embodiment illustrating a passive cooling flow.

The first and second pluralities of fluid passages 142-147, and 171-176 form passive cooling system 50. That is, the first and second pluralities of fluid passages 142-147; and 171-176 deliver cooling fluid from fluid plenum 62 to interior portion 15. The cooling fluid is directed through shroud member 40 toward tip portion 45 of bucket 28 as well as other associated buckets that form the turbine stage. The cooling fluid enters into and mixes with the hot gases that are flowing along the flow path at tip portion 45. The introduction of the cooling fluid tempers, e.g., reduces a temperature of, the hot gases at tip portion 45. In this manner, cooling system 50 enhances an over all service life of bucket(s) 28 by reducing a potential for creep and other mechanical failures. In addition to injecting cooling fluid directly into interior portion 15 at tip portion 45, cooling system 50 can be configured to guide the cooling fluid into a vortex chamber 200 formed in a shroud 240 as shown in FIG. 7 wherein like reference numbers represent corresponding parts in the respective views. The introduction of cooling fluid into vortex chamber 200 creates a turbulence that enhances mixing to further lower temperatures of the hot gases at tip portion 45.

At this point it should be understood that the exemplary embodiments provide a system for passively cooling tip portions of rotating components in a turbomachine. Also, it should be understood that while the cooling system is shown to include both a first and second plurality of fluid passages, exemplary embodiments could be constructed that include one or the other of the first and second plurality of fluid passages. Further, while shown in connection with a gas turbomachine, it should be understood that the exemplary embodiments could be employed in a variety of turbomachine systems. Additionally, while shown passing through a turbine shroud, it should be understood that the cooling fluid could be delivered through other stationary components of the turbomachine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a housing having an outer surface and an inner surface that defines an interior portion, the housing including a fluid plenum;

a rotating member arranged within the housing, the rotating member including at least one bucket having a base portion and a tip portion having an upper surface;

a stationary member mounted to the inner surface of the housing adjacent the tip portion of the at least one bucket; and at least one fluid passage passing through at least a portion of the stationary member, the at least one fluid passage including a first fluid passage having a first fluid passage section defined in the housing that registers with a second fluid passage section defined in the stationary member, the first fluid passage section including a fluid inlet fluidly coupled to the fluid plenum and the second fluid passage section including a fluid outlet exposed to the interior portion, the fluid outlet being configured and disposed to direct a flow of fluid directly toward the upper surface of the tip portion of the at least one bucket.

2. The turbomachine according to claim 1, wherein the at least one fluid passage includes a fluid passage section that extends entirely through the stationary member.

3. The turbomachine according to claim 1, wherein the at least one fluid passage includes a second fluid passage having a first fluid passage portion formed in the stationary member and second passage portion formed in the housing.

4. The turbomachine according to claim 1, wherein the stationary member includes a vortex chamber, the fluid outlet of the at least one fluid passage opening into the vortex chamber.

5. The turbomachine according to claim 1, wherein the stationary member comprises a shroud member having at least one hook section, the at least one fluid passage passing through at least a portion of the hook section.

6. The turbomachine according to claim 5, wherein the at least one fluid passage includes a fluid passage section that passes entirely through the at least one hook section of the shroud member.

7. The turbomachine according to claim 5, wherein the at least one fluid passage includes a first fluid passage portion formed in the at least one hook section and a second passage portion formed in the housing.

8. The turbomachine according to claim 5, wherein the at least one fluid passage includes a first fluid passage including a fluid passage section that passes entirely through the at least one hook section and a second fluid passage, the second fluid passage having a first fluid passage portion formed in the at least one hook section and second passage portion formed in the housing.

9. The turbomachine according to claim 5, wherein the shroud member includes a vortex chamber formed in the hook section, the fluid outlet of the at least one fluid passage opening into the vortex chamber.

10. The turbomachine according to claim 1, wherein the turbomachine comprises a turbine portion of a turbomachine system.

11. A method of passively cooling a turbomachine comprises:

rotating a rotating member including at least one bucket having a tip portion, the tip portion passing in proximity to a stationary member;

passing a fluid flow through a fluid plenum formed in a housing of the turbomachine toward the stationary member; and guiding the fluid flow through at least one fluid passage including a first fluid passage having a first fluid passage section defined in the housing that registers with a second fluid passage section defined in the stationary member that extends from the fluid plenum through at least a portion of the stationary member directly toward an upper surface of the tip portion of the at least one bucket for passively cooling the turbomachine.

12. The method of claim 11, wherein guiding the fluid flow through the at least one fluid passage includes passing the fluid flow through a plurality of fluid passage sections that extend entirely through the stationary member.

13. The method of claim 11, wherein guiding the fluid flow through the at least one fluid passage includes passing the fluid flow through a plurality of fluid passages that are defined between the stationary member and the housing.

14. The method of claim 11, wherein guiding the fluid flow through the at least one fluid passage further includes passing the fluid flow through a second fluid passage having a first fluid passage portion formed in the stationary member and second passage portion formed in the housing.

15. The method of claim 11, further comprising: discharging the fluid into a vortex chamber formed in the stationary member.

16. The method of claim 11, wherein guiding the fluid flow through at least one fluid passage that extends from the fluid plenum through at least a portion of the stationary member comprises guiding the fluid flow through at least a portion of a shroud member.

17. The method of claim 16, wherein guiding the fluid flow through at least a portion of a shroud member includes guiding the fluid flow through a hook section of the shroud member.

18. The method of claim 16, wherein guiding the fluid flow through at least a portion of a shroud member includes guiding the fluid flow between a hook section of the shroud member and the housing.

* * * * *